United States Patent [19]

Lahtinen

[11] 4,226,252

[45] Oct. 7, 1980

[54] ELECTRO-MECHANICAL WINNINGS DISTRIBUTION ASSEMBLY FOR SLOT MACHINES

[76] Inventor: Paavo Lahtinen, Kaskenpolttajantie 11, 02340 Espoo 34, Finland

[21] Appl. No.: 946,572

[22] Filed: Sep. 28, 1978

[51] Int. Cl.[3] ..... G07D 1/00

[52] U.S. Cl. ..... 133/1 R; 133/4 R; 221/296; 221/301

[58] Field of Search ..... 133/1 R, 4 A, 4 R, 5 R; 221/93, 94, 289, 296, 299, 301; 194/2, DIG. 11

[56] References Cited

U.S. PATENT DOCUMENTS

| | | | |
|---|---|---|---|
| 862,923 | 8/1907 | Linsley | 221/296 |
| 3,187,760 | 6/1965 | Simjian | 133/4 R |

FOREIGN PATENT DOCUMENTS

| | | | |
|---|---|---|---|
| 4717 | 9/1895 | Finland | 133/4 R |
| 1087361 | 10/1967 | United Kingdom | 194/DIG. 11 |
| 1275402 | 5/1972 | United Kingdom | 133/4 A |

*Primary Examiner*—Joseph J. Rolla
*Attorney, Agent, or Firm*—Shenier & O'Connor

[57] ABSTRACT

An electro-mechanical winnings distribution assembly for a slot machine in which a release coin operates a microswitch to produce a pulse which is fed to an electromagnet to pivot a winnings distribution lever against the action of a spring from a position at which pins on the lever move from a position in the marginal spaces of rows of coins in edge-to-edge relationship to a position out of the spaces.

4 Claims, 2 Drawing Figures

ELECTRO-MECHANICAL WINNINGS DISTRIBUTION ASSEMBLY FOR SLOT MACHINES

BACKGROUND OF THE INVENTION

A generally known winnings distribution assembly or mechanism is such in which the release coin controls through a suitable link mechanism a winnings distribution lever engaging the edge of the row of coins, the turning movement of this lever admitting, depending on the design of the lever, one or more coins to drop off the panel down into a winnings bowl or tray. A drawback in such mechanical winnings distribution assemblies is that the amount of winnings is difficult to adjust afterwards. Thus, the desired amount of winnings should be known already in the manufacture step of a slot machine which restricts the marketing of slot machines for various locations. In some cases the desired maximum winnings are relatively small compared to what is desirable in certain larger casinos. Since some equipment cannot be adapted to these varying conditions, it is necessary to manufacture relatively small quantities at higher price. Another drawback in these mechanical winnings distribution assemblies is that the winnings distribution on the panel is predetermined, which often results in situations that the coin rows giving the biggest winnings have become empty while other rows are full. Naturally this decreases the operating capacity of slot machines. Still another notable drawback is that the wear of carefully adjusted lever mechanisms makes the operation of the winnings distribution assembly unreliable as the time passes.

SUMMARY OF THE INVENTION

The object of the invention is to provide an electromagnetic winnings distribution assembly by which all the above drawbacks can be avoided. According to the invention, this object is accomplished so that the release coin is adapted to control, by means of a pulse given by a microswitch, a magnet or a relay which, when pulling, for the short period turns a winnings distribution lever against the force of a spring or the like, said lever comprising above and below its pivot axis pins or similar projecting means which are alternately urged inside the marginal zone of the coin row depending whether the magnet or relay is pulling or at rest. Now it is possible with simple electric connections to select and control the amount of winnings and the distribution of winnings on the panel in horizontal and vertical directions. This can be accomplished by connecting the microswitch, which is fitted for a release coin hitting given points, to desired magnets or relays.

According to a preferred embodiment of the invention, the winnings distribution lever is in the form of a plate and comprises at least four pins which are distributed on two adjacent coin rows. This way the number of individual winnings distribution assemblies can be cut down to half.

Further, according to a preferred embodiment of the invention, the vertical distance between the pins is slightly smaller than the diameter of a coin or multiple of the diameter. The distance of the coins is thus chosen so that the pin, that is being pressed into the coin row between the coins, always hits the region of the split line between the coins, i.e. directly on the empty spot at the edge or nip between the marginal zones of two coins.

Further, according to a preferred embodiment of the invention, the winnings distribution lever is encompassed in a housing having holes for the projection of the pins of the lever and a hole for the insertion of the magnet or of the drive means of the coil. The winnings distribution lever encapsulated this way cannot be effected on from outside, e.g. by means of flexible screw cables, which is the case in some mechanical solutions.

BRIEF DESCRIPTION OF THE DRAWINGS

The invention is illustrated below with reference made to the accompanying drawings, in which.

DESCRIPTION OF THE PREFERRED EMBODIMENT

Figure 2:
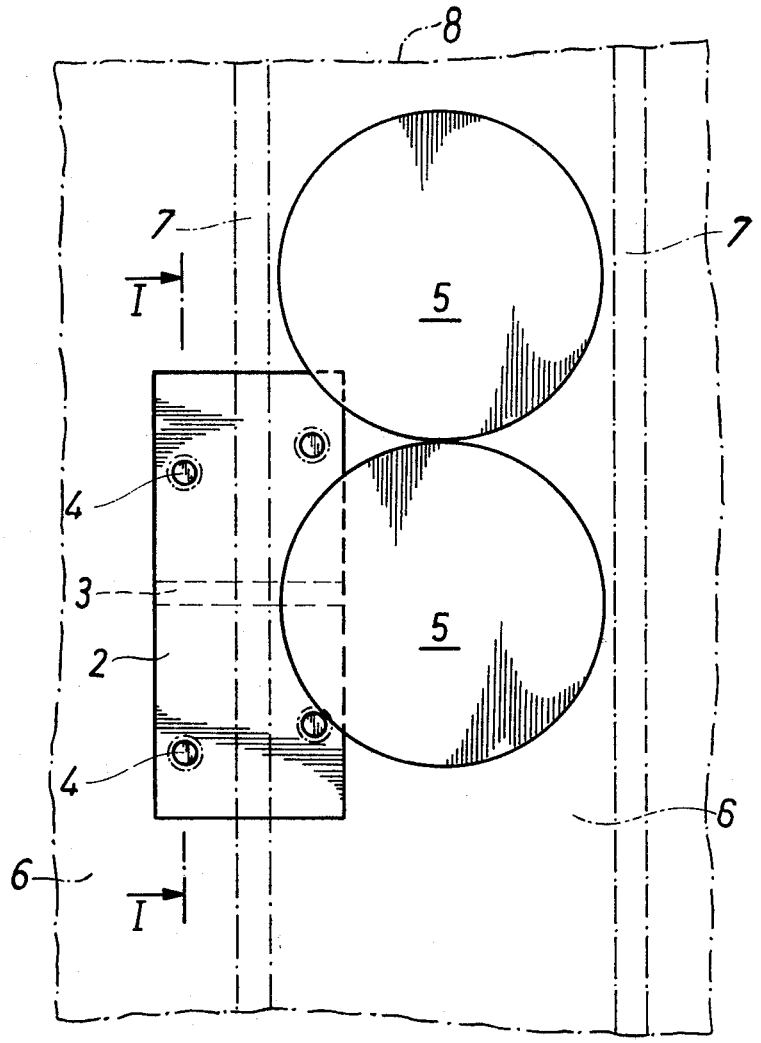
FIG. 2 is a front view of the winnings distribution assembly depicting its co-operation with the coins in a coin row.

Within the frame box 1 a winnings distribution lever 2 is journaled so as to pivot around the axis 3. Lever 2 is in the form of a plate and comprises four pins 4 positioned as shown in FIG. 2. If the purpose is to release one prize coin from both adjacent coin rows, the vertical distance between the pins 4 is, as shown, slightly smaller than the diameter of the coins 5. Thus, the upper pin 4 hits the split point between two coins 5 placed on the top of each other, i.e. in the middle of the empty space at the margin of the coin row 6. The coin row 6 is conventionally limited by spacing strips 7 which are secured to the top surface of the face 8 of a slot machine. Coin rows 6 and spacing strips 7 are of course further covered with a transparent glass, plex or a like sheet which is not shown.

Figure 1:
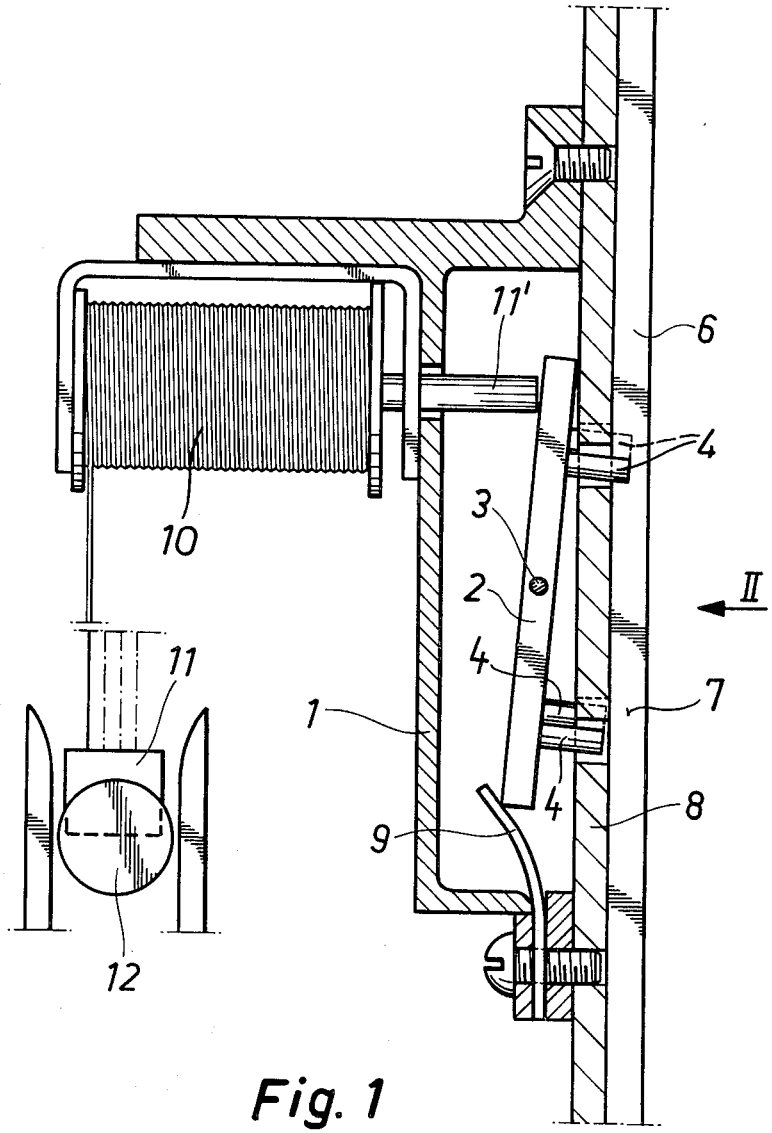
FIG. 1 shows the winnings distribution assembly of the invention in elevational section from the side.

FIG. 1 shows the situation in which the release coin 12 has just passed the microswitch 11 which has given a pulse to the coil 10 of a relay. Relay 10 has pulled and is thus pushing, by means of pin 11, the winnings distribution lever 2 around the axis 3 against the force of spring 9 into the position shown in FIG. 1, the upper pins 4 having been pushed into coin rows 6 and the lower pins 4 withdrawn from the coin rows 6. Thus the lowest coins 5 of two adjacent coin rows have dropped down into the winnings bowl. After the certain delay, relay 10 returns to rest position, the spring 9 pivoting the winnings distribution lever to such a position that lower pins 4 are pushed into the coin row and upper pins 4 leave the same. Thus, the coin rows that were supported by the upper pins 4 drop through the distance between the pins 4 downwards to rest on the lower pins 4. Similar action occurs in all coin rows which are adapted to be controlled by the same microswitch 11. Since the number and position of the relays 10 controlled by each switch 11 on the panel as well as the delay time which relays are pulling can be easily adjusted and varied even afterwards, it can be appreciated that the object of the invention, i.e. the control of the amount of winnings and arbitrary selection of winnings distribution, can be readily accomplished.

It is obvious that the invention is not limited to the above embodiment. Thus, the illustrated distance between pins 4 can be increased by one or more distances corresponding to the diameter of the coin, the total distance always remaining, however, smaller than the multiple of the diameter of the coin. Release coin 12 can be made to effect on the microswitch 11 capacitively, inductively, mechanically, photoelectrically etc.

Having thus described my invention, what I claim is:

1. An electro-mechanical winnings distribution assembly for slot machines or the like including in combination, means for supporting a pair of adjacent columns of coins on end, a lever, means supporting said lever adjacent to said columns for pivotal movement between a payoff position and a coin retaining position, a first pair of spaced pins adjacent the ends of said lever and associated with one of said columns, a second pair of spaced pins adjacent the ends of said lever and associated with the other of said columns, the pins adjacent one end of said lever and the pins at the other end of said lever alternately respectively entering said columns and being withdrawn from said columns in the two positions of said lever, means normally holding said lever in said coin retaining position and means responsive to a payout coin for moving said lever to said payoff position.

2. An assembly as in claim 1 in which the spacing between the pins of each pair is slightly less than an integral multiple of the diameter of a coin contained in the column with which the pair of pins is associated.

3. An assembly as in either claim 2 or claim 1 including a housing encapsulating said lever, said housing being provided with first openings for said pins and with a second opening for a lever actuating element.

4. An electro-mechanical winnings distribution assembly for slot machines or the like including in combination, means for supporting a column of coins on end, a lever, a pair of pins adjacent to the respective ends of said lever, means mounting said lever adjacent to said column for pivotal movement between a payoff position at which one of said pins releases a number of coins from said column while the other pin retains other coins in said column and a coin retaining position at which said one pin retains all of the coins in said column, means for biasing said lever to its coin retaining position, electromagnetic means adapted to be energized to move said lever to its payoff position, means responsive to a payout coin for producing an electrical pulse, and means including variable delay means responsive to said pulse for energizing said electromagnetic means for a predetermined period of time.

* * * * *